US006959565B2

(12) United States Patent
Furuya

(10) Patent No.: US 6,959,565 B2
(45) Date of Patent: Nov. 1, 2005

(54) CIRCULARLY KNITTED FABRIC FOR FASHIONING CLOTHES

(75) Inventor: Kazuo Furuya, Nishitokyo (JP)

(73) Assignee: Asahi Kasei Fibers Corporation, Osaka (JP)

( * ) Notice: Subject to any disclaimer, the term of this patent is extended or adjusted under 35 U.S.C. 154(b) by 0 days.

(21) Appl. No.: 10/492,546

(22) PCT Filed: Oct. 15, 2002

(86) PCT No.: PCT/JP02/10673

§ 371 (c)(1),
(2), (4) Date: Apr. 14, 2004

(87) PCT Pub. No.: WO03/033797

PCT Pub. Date: Apr. 24, 2003

(65) Prior Publication Data

US 2005/0016223 A1 Jan. 27, 2005

(30) Foreign Application Priority Data

Oct. 15, 2001 (JP) ..... 2001-317133

(51) Int. Cl.[7] ..... D04B 1/18
(52) U.S. Cl. ..... 66/202; 66/172 E; 442/306
(58) Field of Search ..... 66/8, 202, 172 R, 66/172 E, 178 R, 178 A; 2/239–242; 442/304, 306, 308, 309

(56) References Cited

U.S. PATENT DOCUMENTS

| | | | | | |
|---|---|---|---|---|---|
| 5,198,288 | A | * | 3/1993 | Grunfeld | 442/306 |
| 5,687,587 | A | * | 11/1997 | Michel | 66/196 |
| 6,263,707 | B1 | * | 7/2001 | Miller et al. | 66/171 |
| 6,472,494 | B2 | * | 10/2002 | Houser et al. | 528/61 |
| 6,776,014 | B1 | * | 8/2004 | Laycock et al. | 66/198 |

FOREIGN PATENT DOCUMENTS

| | | |
|---|---|---|
| JP | 7-102485 | 4/1995 |
| JP | 11-200148 | 7/1999 |
| JP | 2001-279552 | 10/2001 |

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

A circularly knitted fabric for fashioning clothes prior to heat treatment, formed out of a polyurethane elastic fiber and a non-elastic fiber, the polyurethane elastic fiber satisfying the condition, $1 \leqq R/S \leqq 12$, wherein $R/S\ (\%)=(R_3/S_1)\times 100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test.

12 Claims, No Drawings

CIRCULARLY KNITTED FABRIC FOR FASHIONING CLOTHES

FIELD OF THE INVENTION

The present invention relates to a circularly knitted fabric, for fashioning clothes for which a polyurethane elastic fiber is used, and to a method for producing the same.

BACKGROUND ART

Complicated sewing steps are omitted as much as possible for fashioning clothes formed out of a circularly knitted fabric, prepared by knitting in a circular form without sewing at least a part thereof, and the clothes have no seam allowance. As a result, the clothes give a comfortable feel to the wearers, and circularly knitted fabrics prevail in the field of outerwear such as spats and also in the field of underwear such as shorts, briefs and brassiere.

For the purpose of imparting stretchability to fashioning clothes, elastic fibers such as polyurethane fibers are used in combination with conventional non-elastic fibers. Consequently, the silhouette of the wearer's body is known to become beautiful due to the increased stretchability of the knitted fabric. Use of an elastic fiber, in combination, increases the stretchability of the knitted fabric for fashioning clothes, and improves the supporting function such as of a body silhouette to make the knitted fabric adapted to consumers' needs. On the other hand, because the constraining forces across the wearer's body becomes strong, the wearer sometimes has an uncomfortable feel during wear.

Furthermore, when an elastic fiber such as a polyurethane one is used for knitting the fabric, the fabric has a high density and becomes thick, and the size of the body part of the fashioning clothes becomes small. As a result, many courses must be formed, to maintain a necessary size per garment. The amount of the fiber used per garment is therefore increased, and a problem, that a lightweight garment cannot be obtained, occurs.

In order to solve such a problem, attempts to knit a fabric with a sparse stitch have been made when a circularly knitted fabric for fashioning clothes were knitted. However, when an elastic fiber is used in combination, the knitted fabric density does not decrease substantially, even if a sparse stitch is used, due to the shrinkage force of the elastic fiber, and only a thick fabric is obtained.

A conventional widely-used circularly knitted fabric is usually opened, and fed to a dry heat setting machine of a tenter type to decide the fabric size.

In contrast to the above circularly knitted fabric, fashioning clothes are often dyed, without sewing the body part of the clothes, while the fabric is in a circular form. The knitted fabric subsequent to dyeing is then fitted into a metal frame and set to decide the size thereof. When the metal frame size is made significantly large and the knitted fabric is set at high temperature, the knitted fabric becomes relatively thin. However, when this procedure is employed, the following problem arises: the knitted fabric portion that is contacted with the metal frame receives a large amount of heat in comparison with the knitted portion that is not contacted therewith to produce uneven setting. Moreover, because the knitted fabric is contacted with the metal frame, breakage of the polyurethane elastic fiber and yellowing of the non-elastic fiber take place when the setting temperature is made excessively high. Consequently, the setting temperature cannot be made significantly high.

As a result, fashioning clothes for which an elastic fiber is used to increase the stretchability of the knitted fabric become thick and the length thereof becomes short. Moreover, when the numbers of knitted stitches is increased, the amount of the fiber used increases, and the weight per garment increases. In addition to this problem, another problem, that the production efficiency in the heat setting decreases, also arises.

In order to improve the problems, the stretch ratio of the elastic fiber is set at a value as low as possible when knitting is conducted in order that the elastic fiber shows soft stretchability. However, when a bare yarn of the elastic fiber is fed to a knitting machine with fashioning mechanism at a low stretch ratio, the elastic yarn is hardly unwound smoothly from the cheese. As a result, the problems that yarn breakage often takes place on the knitting machine, to lower the production efficiency, and defects are formed in the products, remain. Moreover, when a covering textured yarn in which an elastic fiber, as a core, is covered with a covering yarn such as a polyester or nylon yarn, is used, the following problems arise: poor unwindability, or the like, of the fiber occurs during the covering texturing step; because the elastic fiber has a low traveling tension, it yields to a winding tension caused by the ballooning of the covering yarn, and uneven covering, like corkscrew twisting and uneven drawing, is formed on the covering textured yarn to deteriorate the quality of the knitted fabric.

DISCLOSURE OF THE INVENTION

An object of the present invention is to provide a circularly knitted fabric for fashioning clothes useful for obtaining fashioning clothes that have soft stretchability and a low weight per garment, produced by the low density and light gauge of the knitted fabric, and that give no unnatural constrained feel and an excellent wearable feel. In addition, pantyhose, socks and non-sewn clothes prepared by flat knitting do not correspond to the fashioning clothes in the present invention.

As a result of intensively carrying out investigations, the present inventors have discovered that the above object can be achieved by using a specific polyurethane elastic fiber, and have thus completed the present invention.

That is, the present invention is as described below.

1. A circularly knitted fabric for fashioning clothes prior to heat treatment, formed out of a polyurethane elastic fiber and a non-elastic fiber, the polyurethane elastic fiber satisfying the following condition:

$$1 \leq R/S \leq 12$$

wherein $R/S\ (\%) = (R_3/S_1) \times 100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test.

2. The circularly knitted fabric for fashioning clothes, according to 1. described above, wherein the non-elastic fiber is composed of a crimp-textured synthetic multifilaments, and the fabric area of the circularly knitted fabric in a stretched state is from at least 1.5 to 3 times the area of the circularly knitted fabric in a relaxed state.

3. The circularly knitted fabric for fashioning clothes, according to any one of 1. or 2. described above, wherein the polyurethane elastic fiber is a polyurethane elastic one that is heat treated in a stretched state.

4. The circularly knitted fabric for fashioning clothes, according to any one of 1. to 3. described above, wherein the polyurethane elastic fiber is obtained by dry spinning.

5. Fashioning clothes prepared by partly sewing the circularly knitted fabric for fashioning clothes, according to any one of 1. to 4. described above, while the circularly knitted fabric is not entirely opened.

6. A method for producing a circularly knitted fabric for fashioning clothes, according to 1. described above, comprising feeding a polyurethane elastic fiber in combination with a non-elastic fiber, while the polyurethane elastic fiber is being stretched, to a circularly knitting machine equipped with a fashioning mechanism to form a knitted fabric for the body part of the clothes, the polyurethane elastic fiber satisfying the following condition:

$$1 \leqq R/S \leqq 12$$

wherein R/S (%)=$(R_3/S_1)\times 100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test.

7. The method for producing a circularly knitted fabric for fashioning clothes, according to 6. described above, wherein the stretch ratio of the polyurethane elastic fiber is 2.2 or less.

8. The method for producing a circularly knitted fabric for fashioning clothes, according to 6. or 7. described above, wherein the polyurethane elastic fiber is heat treated while being in a stretched state and then fed to a circularly knitting machine.

9. The method for producing a circularly knitted fabric for fashioning clothes, according to any one of 6. to 8. described above, wherein the polyurethane elastic fiber is obtained by dry spinning.

10. A method for producing fashioning clothes, comprising partly sewing the circularly knitted fabric, produced by the production method according to any one of 6. to 9. described above, while the circularly knitted fabric is not entirely opened.

The present invention will be explained in detail.

The circularly knitted fabric for fashioning clothes of the present invention is a circularly knitted fabric prior to heat treatment used for fashioning clothes that are continuously formed according to the body part. The heat treatment designates a heat treatment to which the circularly knitted fabric is subjected during dyeing, presetting, finish setting, and the like treatment.

The circularly knitted fabric for fashioning clothes of the invention is formed out of a polyurethane elastic fiber and a non-elastic fiber.

The circularly knitted fabric for fashioning clothes of the present invention is characterized in that a polyurethane elastic fiber satisfies the condition: $1 \leqq R/S \leqq 12$ wherein R/S (%)=$(R_3/S_1)\times 100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test. That is, the stress in stretching of the elastic fiber used for the knitted fabric is made high and the stress in recovery is made low so that the stresses fall in the above range. As a result, the following effects are achieved: problems produced by low traveling stress during texturing are avoided; the knitted fabric is made to have no excessively high density; and soft elasticity is imparted thereto.

A small R/S ratio is preferred in order to make the knitted fabric become light gauged, and have a soft stretchability and a large stitch density. However, when the R/S ratio becomes too small, there is no substantial difference between the above knitted fabric and a knitted fabric prepared from a non-elastic fiber alone, and the resultant fabric becomes deficient in stretchability. Accordingly, the lower limit of the R/S ratio is at least 1, and the R/S ratio is preferably from 2 to 9. When the R/S ratio is from 1 to 12, the stress in recovery of the elastic fiber becomes suitable, and the knitted fabric has a suitable shrinkage. The knitted fabric therefore has elasticity specific to the elastic fiber, provides an excellent wearable feel, and takes the silhouette of the wearer's body.

In the present invention, there is no specific limitation on the non-elastic fiber, and the non-elastic fiber may be a natural or synthetic fiber in accordance with the applications. In particular, the non-elastic fiber is preferably crimp textured synthetic fiber multifilaments. Because the crimp textured multifilaments themselves have a low bending stiffness, they are significantly stretched with a weak force in the knitted fabric, and can adequately transmit the elasticity of the polyurethane elastic fiber used in combination to the knitted fabric. The multifilaments are therefore preferred in view of obtaining a lightweight knitted fabric having soft elasticity.

In the present invention, the fabric area of the circularly knitted fabric for fashioning clothes in a stretched state is preferably from at least 1.5 to 3 times the fabric area thereof in a relaxed state, more preferably from at least 2.0 to 2.5 times that. When the ratio of the fabric areas is in the above range, the knitted fabric has the following advantages: it does not become thick; it gives a suitable constrained feel to the wearer; the elastic function the elastic fiber has is fully utilized, and a knitted fabric having excellent kickback properties are obtained.

Moreover, when the above R/S ratio of the polyurethane elastic fiber is 12 or less, the ratio of the fabric areas becomes 3 or less. Furthermore, when the R/S ratio is 9 or less, the ratio of the fabric areas becomes 2.25 or less; as a result, fashioning clothes that give a suitable constrained feel while taking the silhouette on the body, and the clothes are more excellent in a wearable feel, are obtained therefrom. This ratio is therefore preferred.

As explained above, the polyurethane elastic fiber used for the circularly knitted fabric for fashioning clothes of the invention is a specific one that satisfies the condition, $1 \leqq R/S \leqq 12$. Examples of such a specific polyurethane elastic fiber include a polyurethane-urethane elastic fiber that has no hard segments composed of urea groups and forms physical crosslinking with firm hydrogen bonding to exhibit excellent heat resistance, a polyurethane-urea elastic fiber containing a specific urea compound added so that the heat setting ability is increased and the R/S ratio is made relatively small, or a melt-spun polyurethane elastic fiber.

Furthermore, the polyurethane elastic fiber used in the present invention can be obtained by heat treating a conventional polyurethane elastic fiber that shows an R/S ratio greater than 12 while the elastic fiber is in a stretched state under constant stretching, to be heat set. Although such stretching and heat setting treatment makes the elastic fiber thin and show a small stress in recovery in stretching and recovery, the stress in the first stretching in stretching and recovery is significantly improved due to the orientation of the hard segments. A specific polyurethane elastic fiber satisfying the condition, $1 \leqq R/S \leqq 12$, can therefore be obtained by selecting appropriate conditions according to the type of a conventional polyurethane elastic fiber.

Examples of the conventional polyurethane elastic fiber showing an R/S ratio greater than 12 include (1) a polyurethane-urea elastic fiber obtained by reacting a diamine with a polyurethane polymer obtained from an organic diisocyanate compound and one or at least two homopolymers or copolymers of polyalkylene ether diol in which linear or branched alkylene groups each having 2 to 10 carbon atoms are bonded with an ether linkage and which have a number average molecular weight of from 500 to 5,000, and (2) a polyurethane-urethane elastic fiber obtained by reacting a diol such as 1,4-butanediol in place of the diamine with the above polyurethane polymer.

The above conventional polyurethane elastic fiber may be singly subjected to the stretching and heat setting treatment. Alternatively, it may also be subjected thereto during doubling, false twisting or the like procedure in combination with a non-elastic fiber.

Furthermore, in the present invention, a polyurethane elastic fiber produced by dry spinning is preferred as the above conventional polyurethane elastic fiber, and the elastic fiber is preferably subjected to stretching and heat setting treatment before use. A conventional method of dry spinning a polyurethane elastic fiber comprises spinning a spinning solution prepared by dissolving a polymer in a solvent such as dimethylacetamide from a nozzle head within a spinning cylinder into which a hot gas is introduced, whereby the solvent is removed.

A polyurethane elastic fiber obtained by dry spinning shows no significant lowering of the stretchability even when the elastic fiber is subjected to wet heat treatment in the post-texturing step such as dyeing, and is excellent in kickback properties. Accordingly, the polyurethane elastic fiber is subjected to stretching and heat setting treatment, and knitted to form the circularly knitted fabric for fashioning clothes of the invention. The circularly knitted fabric is dye finished and sewn to give excellent fashioning clothes that show no shape deformation of the knitted fabric even when the clothes are repeatedly worn.

The circularly knitted fabric for fashioning clothes of the present invention can be produced by feeding a specific polyurethane elastic fiber that satisfies the condition, $1 \leqq R/S \leqq 12$, as explained above to a circularly knitting machine equipped with a fashioning mechanism in combination with a non-elastic fiber while the elastic fiber is being stretched substantially at a stretch ratio of 2.2 or less, preferably 1.9 or less, so that a knitted fabric for the body part of the clothes is formed. When the stretch ratio is 2.2 or less, the shrinkage force of the fabric becomes suitable, and a desired light-gauged circularly knitted fabric is obtained.

In addition, because a specific polyurethane elastic fiber that satisfies the condition, $1 \leqq R/S \leqq 12$, is used, the stress in stretching of the elastic fiber is high even when the elastic fiber is knitted while being stretched at a stretch ratio of 2.2 or less; as a result, no problem in unwindability of the elastic fiber from the cheese arises, and covering texturing causes neither uneven covering nor uneven drawing.

Fashioning clothes providing a suitable constrained feel and an excellent wearable feel can be obtained from the circularly knitted fabric for fashioning clothes of the invention by not entirely opening and partly sewing the circularly knitted fabric. In the present invention, "not entirely opening and partly sewing the circularly knitted fabric" signifies that part of or the entire of the circularly knitted fabric is used in a circular form for the clothes. That is, necessary parts of the circularly knitted fabric alone are opened during preparing the clothes. For example, for a sleeveless upper garment, a knitted fabric for body parts is used in a circular form without opening, and shoulder parts alone of the fabric are sewn to give fashioning clothes of the present invention.

Dyeing may be conducted either in the state of a circularly knitted fabric or in the state of fashioning clothes subsequent to sewing. Finish texturing is generally conducted by fitting the knitted fabric or clothes subsequent to dyeing into a metal frame and heat setting.

BEST MODE FOR CARRYING OUT THE INVENTION

The present invention will be further explained by making reference to examples.

In addition, measurement methods and the like are as explained below.

(1) Fineness

A fiber portion 1 m long is taken from an elastic fiber in a linear and non-stretched state and the weight is determined, from which the fineness of the elastic fiber in terms of dtex is calculated. In addition, when the elastic fiber forms a composite yarn or the like with another fiber, the elastic fiber is taken out therefrom, and the fineness of the elastic fiber thus taken out is similarly determined.

(2) Stress in Expansion, Stress in Recovery

Using a tensile testing machine (trade name of UTM-III-100 type, manufactured by Orientech K.K.), an elastic fiber sample 5 cm long is attached thereto in an atmosphere at 20° C. and a relative humidity of 65% so that a chucking breakage does not take place. The sample is expanded at a expansion rate of 50 cm/min until the expansion becomes 300% from 0%, and then recovered until the expansion becomes 0% from 300%. The procedure is repeated three times. The forward stress ($S_1$) when the fiber is expanded by 200% at the first expansion in a 300% expansion-recovery repetition test, and the reverse stress ($R_3$) when the fiber is recovered at the third 200% recovery in the 300% expansion-recovery repetition test are read from the chart thus obtained. In addition, when the elastic fiber forms a composite yarn or the like with another fiber, the elastic fiber is taken out therefrom, and measurements are similarly made on the elastic fiber thus taken out.

(3) Ratio of Fabric Areas

A freshly knitted fabric obtained from a knitting machine is allowed to shrink naturally for 48 hours. A square, 2 cm×2 cm (defined as the area of the fabric in a relaxed state) is marked on the fabric. The knitted fabric is stretched by applying a load of 2 kg in the warp and weft directions. The expanded area of the square (defined as the area of the fabric in a stretched state) is determined. The latter area is divided by the former one to give an area ratio.

EXAMPLE 1

A polyurethane elastic fiber of 22 dtex (trade name of Roica, manufactured by Asahi Kasei Corporation Ltd.) manufactured by dry spinning and a nylon 66 of 55 dtex 48 filaments were doubled while the elastic fiber was being stretched at a stretch ratio of 2.4. The resultant fiber was fed to a false twisting machine (IVF friction type, manufactured by Toshiba Corporation), and simultaneously false twisted at 165° C. at a draw ratio of 1.1 and a rate of 400 m/min to give a composite yarn. Table 1 shows the physical properties of the elastic fiber in the core portion of the composite yarn thus obtained.

The composite yarn and a false-twisted yarn of a nylon 66 of 22 dtex 24 filaments were fed to a circularly knitting machine equipped with a fashioning mechanism (model SM8-8, manufactured by Santony in Italy, having a needle cylinder diameter of 13 inches (33 cm) and 1,152 needles), and a plain knitting was formed in 2,300 courses with plating stitch to give a circularly knitted fabric for fashioning clothes.

The circularly knitted fabric thus obtained was allowed to shrink naturally for 48 hours, and the size and density were measured. Moreover, a square, 2 cm×2 cm, was marked on the knitted fabric having shrunk. The knitted fabric was stretched by applying a load of 2 kg in the warp and weft directions. The expanded area of the square was measured and the results are shown in Table 2.

As a result, the circularly knitted fabric for fashioning clothes after shrinkage originally having a size of one body part of the clothes showed a 4.5% larger width and a 26.6% larger length in comparison with the one in Comparative Example 1 to be described later. Moreover, the area of the fabric in a stretched state was 2.38 times that in a relaxed state (in a shrunk state).

The circularly knitted fabric thus obtained was dyed, with a paddle dyeing machine, in a circular state and without opening at 95° C. for 45 minutes. The fabric was fitted into a metal board 33 cm wide, and steam set at 120° C. for 40 sec. The circularly knitted fabric after finish setting had a larger finished width and a larger finished length as shown in Table 2.

Most of the body part of the clothes of the circularly knitted fabric was left, and part of the fabric was cut and sewn to give fashioning clothes for a sleeveless intimate apparel. When the fashioning clothes were worn, the body part length of the clothes was sufficient, and the clothes took the silhouette of the body. Moreover, the clothes hardly gave a constrained feel, showed a decreased slip caused by the body movement, and provided a comfortable wearable feel.

COMPARATIVE EXAMPLE 1

A polyurethane-urea elastic fiber (trade name of Roica, manufactured by Asahi Kasei Corporation Ltd.) of 22 dtex manufactured by dry spinning was fed to a covering machine as a core fiber at a stretch ratio of 2.64, and a false-twisted yarn of the same nylon 66 of 55 dtex 48 filaments as in Example 1 was used as a sheath yarn. As a result, a covering textured yarn having a twist number of 500 T/m was obtained. Table 1 shows the physical properties of the elastic fiber in the core portion of the covering textured yarn thus obtained.

The covering textured yarn thus obtained and the false-twisted yarn of a nylon 66 of 22 dtex 24 filaments were used in the same manner as in Example 1, and a circularly knitted fabric for fashioning clothes was obtained by plating stitch.

The circularly knitted fabric thus obtained was allowed to shrink naturally for 48 hours, and the size and density were measured. Moreover, the ratio of the fabric areas was measured in the same manner as in Example 1, and the results are shown in Table 2.

As a result, the area of the fabric in a stretched state was 3.17 times that in a relaxed state.

Fashioning clothes prepared from the circularly knitted fabric in the same manner as in Example 1 gave a poor wearable feel in comparison with that prepared in Example 1.

EXAMPLE 2

When a composite yarn was to be obtained by simultaneous false twisting in the same manner as in Example 1, the elastic fiber and the nylon 66 multifilaments were doubled while the elastic fiber was being stretched at a stretch ratio of 2.4 prior to false twisting, and both fibers were interlaced by passing the doubled fibers through an air nozzle at a fiber speed of 380 m/min and an air pressure of $2.7\times10^2$ kPa to give an interlaced yarn.

When the interlaced yarn thus obtained was false twisted under the same conditions as in Example 1, no yarn breakage took place, and a composite yarn in which the periphery of the elastic fiber was covered with the nylon 66 multifilaments and which showed an improved covering ratio was obtained. Moreover, the composite yarn obtained by false twisting was subjected to additional twist at a rate of 300 T/m with a twisting machine. Table 1 shows the physical properties of the elastic fiber in the core portion of the composite yarn.

A circularly knitted fabric as shown in Table 2 was prepared in the same manner as in Example 1, and fashioning clothes were prepared therefrom. The fashioning clothes thus obtained had a size similar to that in Example 1, and gave an excellent wearable feel. Moreover, the fashioning clothes had uniform stitches and excellent quality such as smooth feel due to the interlacing with an air nozzle and additional twist.

EXAMPLE 3

A polyurethane-urea elastic fiber (trade name of Roica, manufactured by Asahi Kasei Corporation Ltd.) of 17 dtex produced by dry spinning was allowed to travel while being stretched at a stretch ratio of 2.6, was dry heat treated at 180° C. for 3 sec, and was wound in a cheese. The polyurethane-urea elastic fiber thus obtained was in a heat set state, had a fineness as thin as 7.8 dtex, and showed an R/S ratio of 2.2.

The elastic fiber thus obtained and a nylon 6 of 40 dtex 40 filaments were doubled while the elastic fiber was being stretched at a stretch ratio of 1.5. The doubled fibers were interlaced by passing them through an air nozzle at an air pressure of $2.9\times10^2$ kPa to give a composite yarn. Table 1 shows the physical properties of the elastic fiber in the core portion of the composite yarn thus obtained.

The composite yarn thus obtained and a false-twisted yarn of a nylon 6 of 110 dtex 140 filaments were fed to a circularly knitting machine equipped with a fashioning mechanism (model SM8-8, manufactured by Santony in Italy, having a needle cylinder diameter of 13 inches (33 cm) and 1,050 needles), and a plain knitting was formed in 1,150 courses with plating stitch to give a circularly knitted fabric for fashioning clothes.

The circularly knitted fabric thus obtained was allowed to shrink naturally for 48 hours, and the size and density were measured. Moreover, the ratio of the fabric areas was measured in the same manner as in Example 1, and the results are shown in Table 2.

As a result, the circularly knitted fabric for fashioning clothes after shrinkage originally having a size of one body part of the clothes showed a 10.8% larger width and a 27.5% larger length in comparison with the one in Comparative Example 2 to be described later. Moreover, the area of the fabric in a stretched state was 2.25 times that in a relaxed state.

The circularly knitted fabric thus obtained was dyed with a paddle dyeing machine in a circularly state without opening at 95° C. for 45 minutes. The fabric was then fitted into a metal board 40 cm wide, and steam set at 120° C. for 40 sec. The circularly knitted fabric after finish setting had a larger finished width and a larger finished length.

COMPARATIVE EXAMPLE 2

A polyurethane-urea elastic fiber of 17 dtex (trade name of Roica, manufactured by Asahi Kasei Corporation Ltd.) manufactured by dry spinning and a nylon 6 of 40 dtex 40 filaments were doubled while the elastic fiber was being stretched at a stretch ratio of 3.2. The doubled fibers were interlaced by passing them through an air nozzle at an air pressure of $2.9\times10^2$ kPa to give a composite yarn. Table 1 shows the physical properties of the elastic fiber in the core portion of the composite yarn thus obtained.

A circularly knitted fabric for fashioning clothes was obtained in the same manner as in Example 3 except that the composite yarn obtained above was used in place of the composite yarn in Example 3.

The circularly knitted fabric thus obtained was allowed to shrink naturally for 48 hours, and the size and density were measured. Moreover, the ratio of the fabric areas was measured in the same manner as in Example 1, and the results are shown in Table 2.

As a result, the area of the fabric in a stretched state was 3.26 times that in a relaxed state.

Furthermore, when the circularly knitted fabric was steam set in the same manner as in Example 3, the knitted fabric after finish setting had a short width and a short length in comparison with the circularly knitted fabric in Example 3.

TABLE 1

| | Physical properties of polyurethane elastic fiber | | | | | | |
|---|---|---|---|---|---|---|---|
| | Fineness | Stress in expansion (First expansion) | | | Stress in recovery (Third recovery) | | |
| | (dtex) | 100% | 200% ($S_1$) | 300% | 200% ($R_3$) | 100% | R/S |
| Ex. 1 | 18.4 | 1.3 | 6.3 | 21 | 0.5 | 0.1 | 8 |
| C. Ex. 1 | 21.5 | 1.4 | 3 | 7.8 | 0.7 | 0.2 | 23.3 |
| Ex. 2 | 18.1 | 1.3 | 6.2 | 19.8 | 0.4 | 0.1 | 6.5 |
| Ex. 3 | 7.8 | 2.4 | 9.1 | 17.8 | 0.2 | 0 | 2.2 |
| C. Ex. 2 | 17.1 | 1.9 | 3.6 | 7.2 | 0.5 | 0.1 | 13.9 |

TABLE 2

| | Prior to heat treatment (after being allowed to shrink for 48 hours) | | | | Dyed | | After finish setting | | Ratio of fabric areas |
|---|---|---|---|---|---|---|---|---|---|
| | Knitted fabric density | | Size of body part of clothes | | Size of body part of clothes | | Size of body part of clothes | | (stretched state/ |
| | Courses/cm | Wales/cm | Width (cm) | Length (cm) | Width (cm) | Length (cm) | Width (cm) | Length (cm) | relaxed state) |
| Ex. 1 | 28.4 | 16.7 | 34.5 | 81 | 29 | 56.7 | 30.5 | 67.4 | 2.38 |
| C. Ex. 1 | 35.9 | 17.5 | 33 | 64 | 27.6 | 53 | 29 | 54 | 3.17 |
| Ex. 2 | 28.8 | 16.9 | 34.1 | 80 | 29 | 56 | 30.7 | 67.6 | 2.33 |
| Ex. 3 | 18.8 | 13 | 40 | 61.2 | 36.8 | 46.2 | 38.2 | 52.2 | 2.25 |
| C. Ex. 2 | 24 | 14.6 | 36.1 | 48 | 32.4 | 39 | 34.2 | 44.3 | 3.26 |

INDUSTRIAL APPLICABILITY

Because the circularly knitted fabric for fashioning clothes of the present invention has soft stretchability and is light gauged due to a low fabric density, use of the circularly knitted fabric can efficiently provide fashioning clothes that have a low weight per garment, that takes the silhouette of the body of the wearer, and that gives no unnatural constrained feel and has an excellent wearable feel.

What is claimed is:

1. A circularly knitted fabric for fashioning clothes prior to heat treatment, said circularly knitted fabric comprising fabric formed out of a polyurethane elastic fiber and a non-elastic fiber, the polyurethane elastic fiber satisfying the following condition:

$$1 \leqq R/S \leqq 12$$

wherein R/S (%)=$(R_3/S_1)\times100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test.

2. The circularly knitted fabric for fashioning clothes, according to claim 1, wherein the non-elastic fiber is composed of crimp-textured synthetic multifilaments, and the fabric area of the circularly knitted fabric in a stretched state is from at least 1.5 to 3 times the area of the circularly knitted fabric in a relexed state.

3. The circularly knitted fabric for fashioning clothes, according to claim 1 or 2, wherein the polyurethane elastic fiber is a polyurethane elastic one that is heat treated in a stretched state.

4. The circularly knitted fabric for fashioning clothes, according to claim 1 or 2, wherein the polyurethane elastic fiber is obtained by dry spinning.

5. A method for producing a circularly knitted fabric for fashioning clothes, prior to heat treatment, comprising feeding a polyurethane elastic fiber in combination with a non-elastic fiber, while the polyurethane elastic fiber is being stretched, to a circular knitting machine equipped with a fashioning mechanism to form a knitted fabric for the body part of the clothes, the polyurethane elastic fiber satisfying the foliowing condition:

$$1 \leqq R/S \leqq 12$$

wherein R/S (%)=$(R_3/S_1)\times100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test.

6. The method for producing a circularly knitted fabric for fashioning clothes, according to claim 5, wherein the stretch ratio of the polyurethane elastic fiber is 2.2 or less.

7. The method for producing a circularly knitted fabric for fashioning clothes, according to claim 5 or 6, wherein the polyurethane elastic fiber is heat treated while being in a stretched state and then fed to a circularly knitting machine.

8. The method for producing a circularly knitted fabric for fashioning clothes, according to claim 5 or 6, wherein the polyurethane elastic fiber is obtained by dry spinning.

9. A method for fashioning clothes comprising partly sewing a circularly knitted fabric prior to heat treatment, formed out of a polyurethane elastic fiber and a non-elastic fiber, the polyurethane elastic fiber satisfying the following condition:

$$1 \leqq R/S \leqq 12$$

wherein R/S (%)=$(R_3/S_1)\times 100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test, and while the circularly knitted fabric is not entirely opened.

10. The method for fashioning clothes, according to claim 9, wherein the non-elastic fiber is composed of crimp-textured synthetic multifilaments, and the fabric area of the circularly knitted fabric in a stretched state is from at least 1.5 to 3 times the area of the circularly knitted fabric in a relaxed state.

11. A method for fashioning clothes comprising partly sewing a circularly knitted fabric prior to heat treatment produced by feeding a polyurethane elastic fiber in combination with a non-elastic fiber, while the polyurethane elastic fiber is being stretched, to a circular knitting machine equipped with a fashioning mechanism to form a knitted fabric for the body part of the clothes, the polyurethane elastic fiber satisfying the following condition:

$$1 \leqq R/S \leqq 12$$

wherein R/S (%)=$(R_3/S_1)\times 100$, $S_1$ is the forward stress when the fiber is expanded by 200% at the first expansion in a 300% expansion-recovery repetition test, and $R_3$ is the reverse stress when the fiber is recovered at the third 200% recovery in the 300% expansion-recovery repetition test, and while the circularly knitted fabric is not entirely opened.

12. The method for fashioning clothes, according to claim 11, wherein the stretch ratio of the polyurethane elastic fiber is 2.2 or less.

* * * * *